US007651379B1

(12) United States Patent
Wu

(10) Patent No.: US 7,651,379 B1
(45) Date of Patent: Jan. 26, 2010

(54) CABLE ASSEMBLY WITH IMPROVED TERMINATION DISPOSITION

(75) Inventor: Jerry Wu, Irvine, CA (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/288,771

(22) Filed: Oct. 23, 2008

(51) Int. Cl.
*H01R 9/00* (2006.01)

(52) U.S. Cl. ..... 439/660; 439/108; 439/497; 439/579

(58) Field of Classification Search ..... 439/660, 439/108, 497, 579
See application file for complete search history.

(56) References Cited

U.S. PATENT DOCUMENTS

| | | | | |
|---|---|---|---|---|
| 6,447,340 | B1 | 9/2002 | Wu | |
| 6,454,605 | B1 | 9/2002 | Bassler et al. | |
| 6,869,308 | B2 * | 3/2005 | Wu | 439/497 |
| 7,052,292 | B2 | 5/2006 | Hsu et al. | |
| 2004/0067680 | A1 * | 4/2004 | Wu | 439/497 |
| 2005/0003707 | A1 * | 1/2005 | Wu | 439/579 |
| 2006/0246770 | A1 * | 11/2006 | Wu | 439/460 |

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

A cable assembly includes an insulated housing defining a cavity portion along a longitudinal direction; a first contact module including a first insulator combined with a plurality of first contacts, each of the first contacts having a mating portion extending beyond a front surface of the first insulator and a tail portion disposed outside a back surface of the first insulator; a second contact module including a second insulator combined with a plurality of second contacts, each of the second contacts having a mating portion extending beyond a front surface of the second insulator and a tail portion disposed outside a back surface of the second insulator;

the first insulator overlapped with the second insulator, with each of the mating portions of the first contacts disposed into a corresponding gap between two adjacent mating portions of the second contacts, and the tail portions of first contacts spaced apart the tail portions of second contacts; and the first and second contact module inserted into the cavity portion of the insulated housing, with the mating portions of the first contacts and the second contacts extending into a mating port of the insulated housing, and the tail portions of the first and second contacts disposed outside of the cavity portion of the insulated housing and adapted for soldering to wires.

20 Claims, 7 Drawing Sheets

CABLE ASSEMBLY WITH IMPROVED TERMINATION DISPOSITION

FIELD OF THE INVENTION

The present invention generally relates to a cable assembly, and more particularly to a cable assembly having an improved termination disposition.

DESCRIPTION OF PRIOR ART

Many electronic devices rely upon transmission lines to transmit signals between related devices or between peripheral devices and circuit boards of a computer. These transmission lines incorporate signal cables that are capable of high-speed data transmissions.

These signal cables may use what are known as one or more twisted pairs of wires that are twisted together along the length of the cable, with each such twisted pair being encircled by an associated grounding shield. These twisted pairs typically receive complementary signal voltages, i.e., one wire of the pair may see a +1.0 volt signal, while the other wire of the pair may see a −1.0 volt signal. Thus, these wires may be called "differential" pairs, a term that refers to the different signals they carry. At present, HDMI connector is widely used for transmitting signals between a TV and other peripheral device. One of an ordinary HDMI connector has nineteen terminal positions, which are separated into two sets along a vertical direction. The terminals positions are divided into a number of terminals groups, and each terminal group has a differential pair for transmitting signals and a grounding terminal opposite to the differential pair to form a triangular-shaped configuration. However, such arrangement of the terminal dispositions not only increases dimension of an interface of connector, but also has difficult in soldering process and assembling process.

The present invention is therefore directed to a termination structure for providing improved connections between cables and connectors that provides a high level of performance and which maintains the electrical characteristics of the cable in the termination area.

SUMMARY OF THE INVENTION

Accordingly, an object of the present invention is to provide a cable assembly having an improved termination arrangement.

In order to achieve the object set forth, a cable assembly in accordance with the present invention comprises an insulated housing defining a cavity portion along a longitudinal direction; a first contact module including a first insulator combined with a plurality of first contacts, each of the first contacts having a mating portion extending beyond a front surface of the first insulator and a tail portion disposed outside a back surface of the first insulator; a second contact module including a second insulator combined with a plurality of second contacts, each of the second contacts having a mating portion extending beyond a front surface of the second insulator and a tail portion disposed outside a back surface of the second insulator;

the first insulator overlapped with the second insulator, with each of the mating portions of the first contacts disposed into a corresponding gap between two adjacent mating portions of the second contacts, and the tail portions of first contacts spaced apart the tail portions of second contacts; and the first and second contact module inserted into the cavity portion of the insulated housing, with the mating portions of the first contacts and the second contacts extending into a mating port of the insulated housing, and the tail portions of the first and second contacts disposed outside of the cavity portion of the insulated housing and adapted for soldering to wires.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
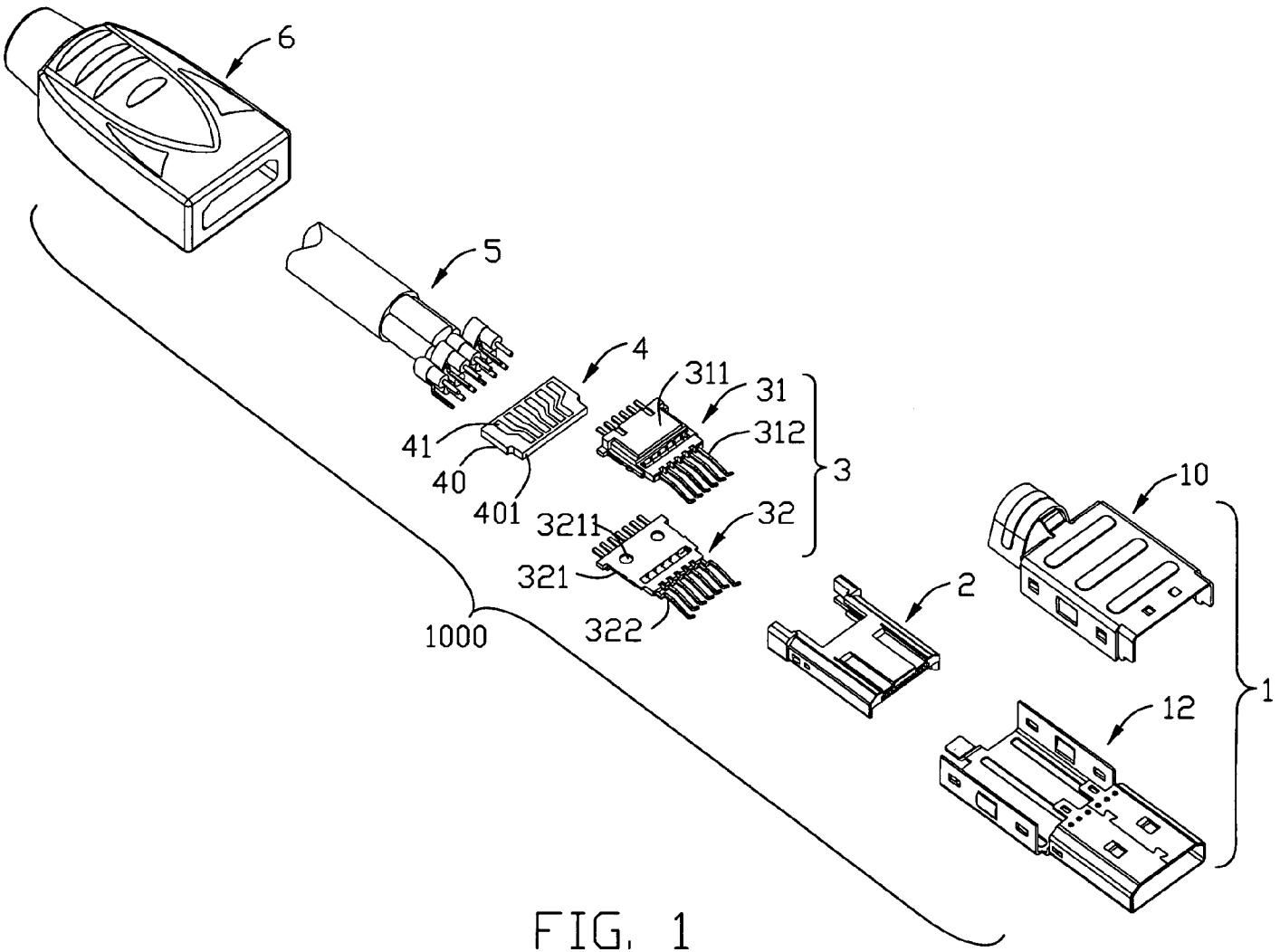
FIG. 1 is an exploded, perspective view of a cable assembly.
Figure 2:
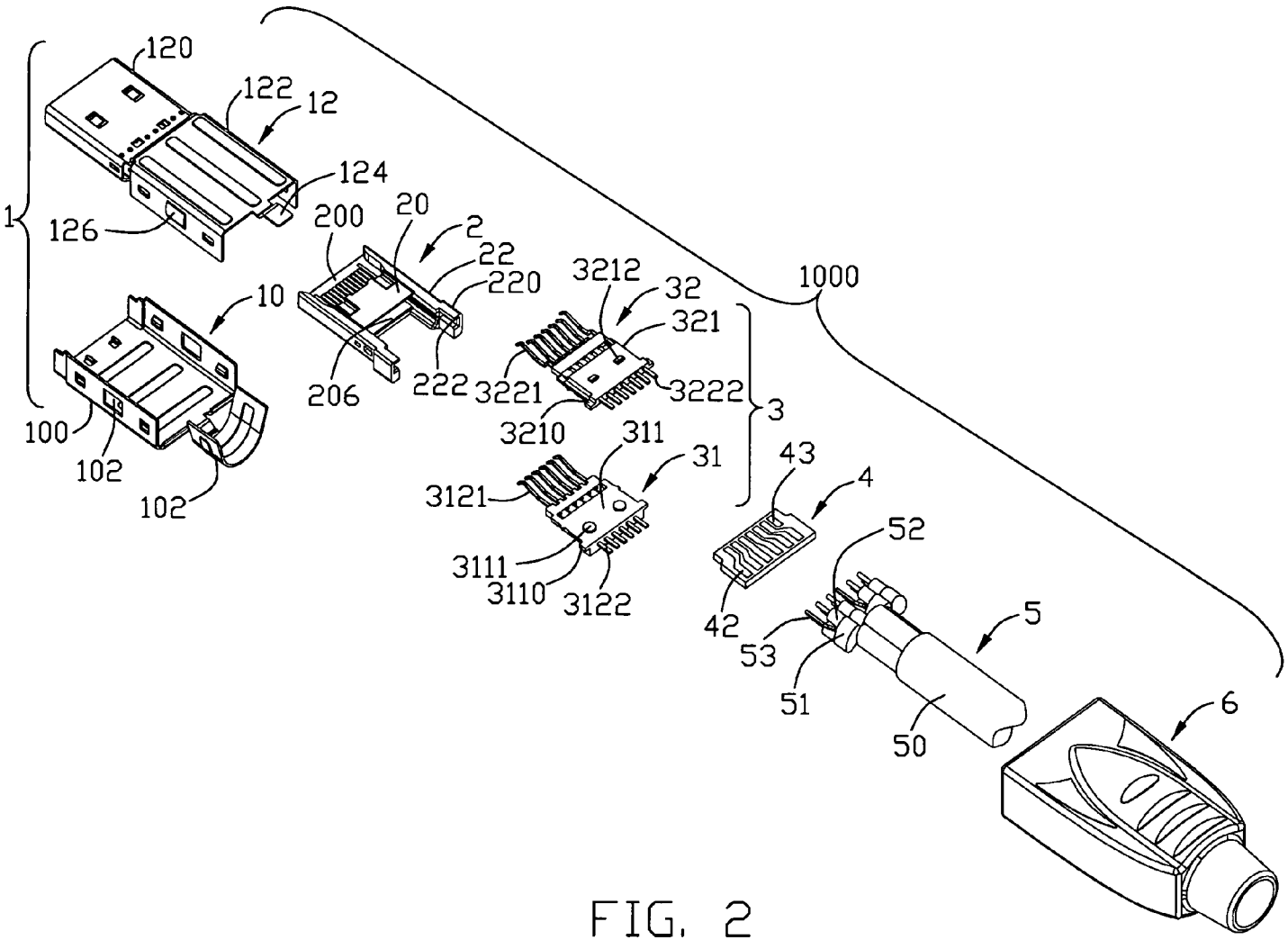
FIG. 2 is similar to FIG. 1, but viewed from another aspect.
Figure 3:
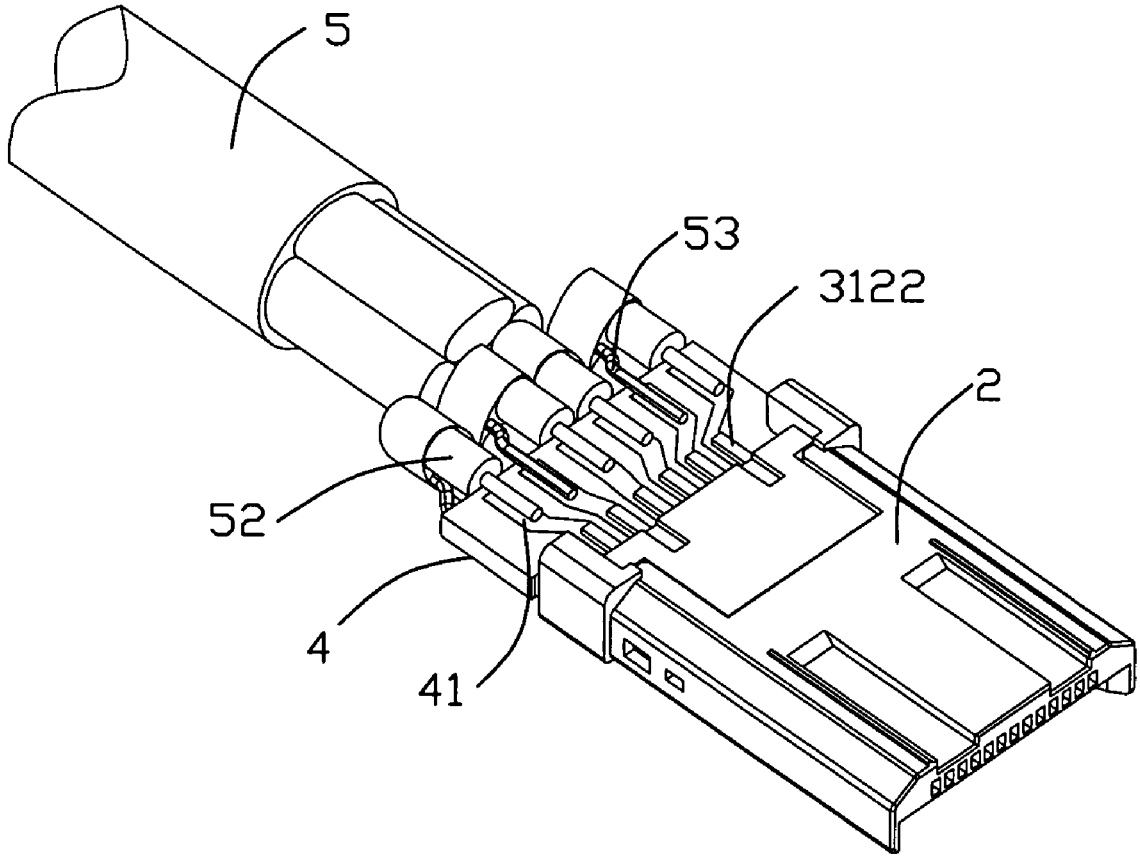
FIG. 3 is a partially assembled view of the cable assembly.
Figure 4:
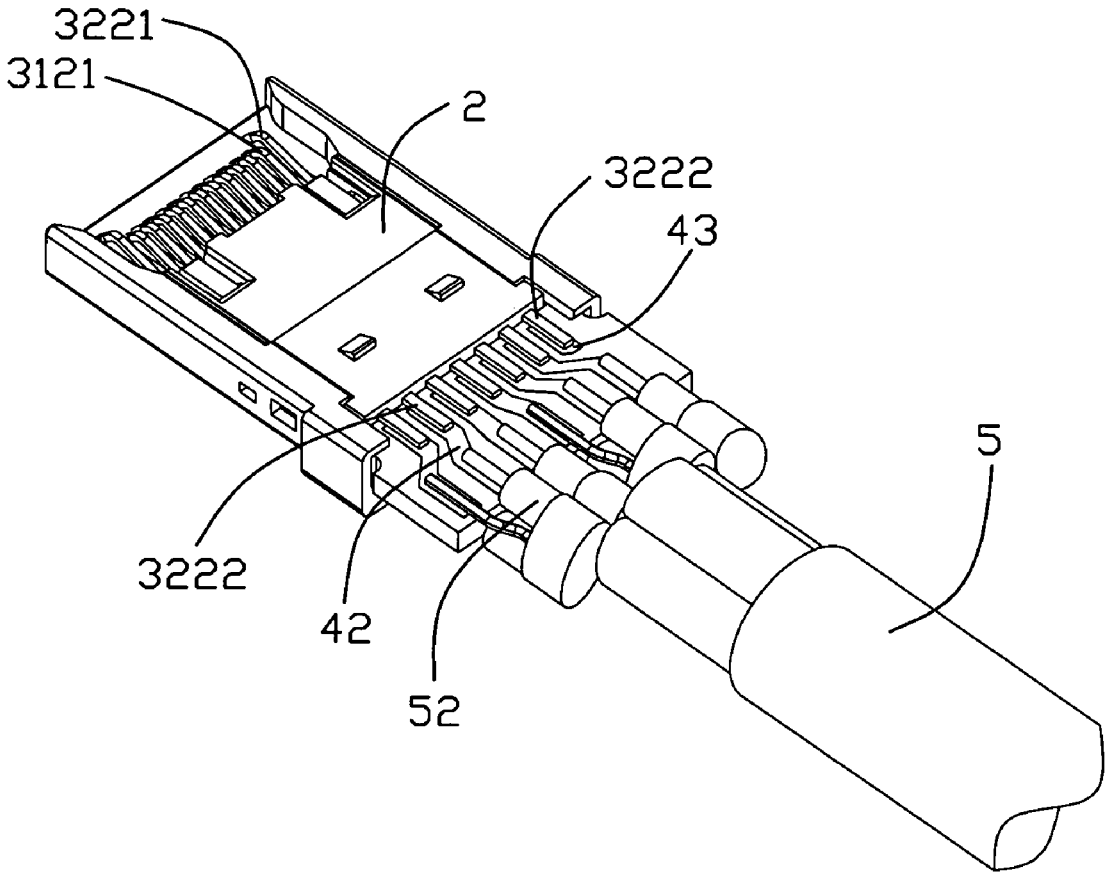
FIG. 4 is similar to FIG. 3, but viewed from another aspect.
Figure 5:
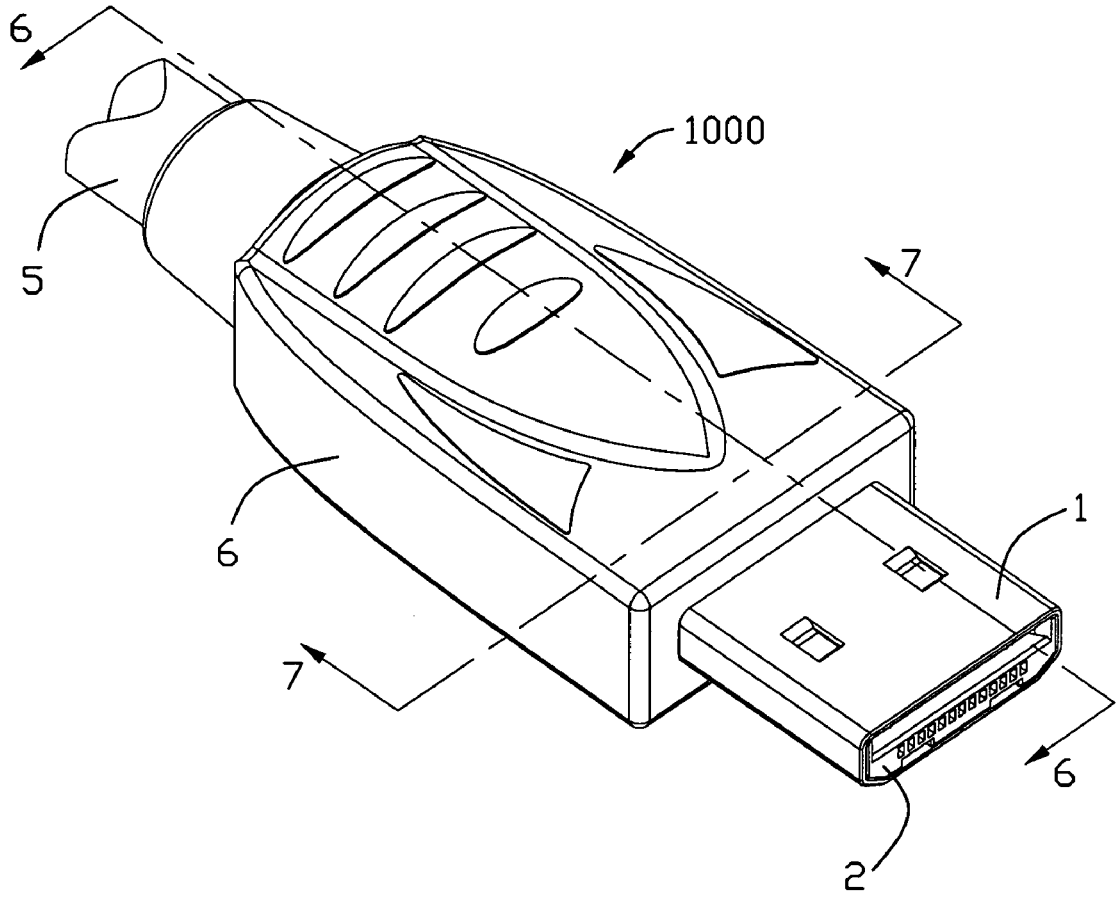
FIG. 5 is an assembled, perspective view of the cable assembly.
Figure 6:
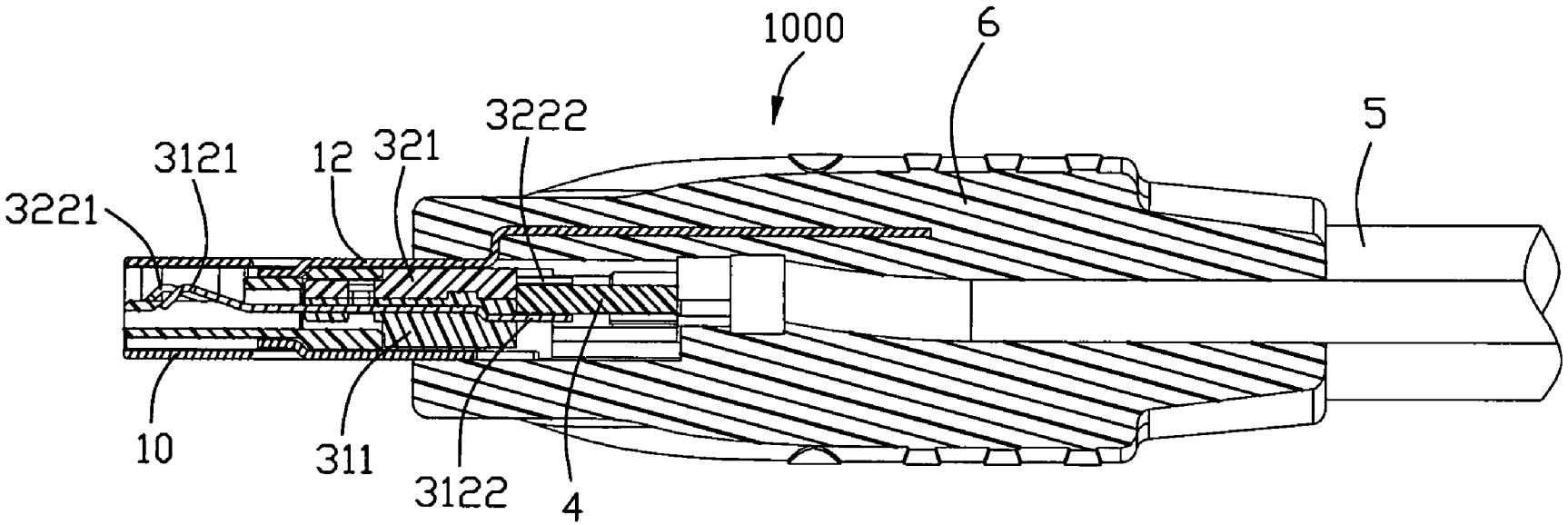
FIG. 6 is a cross-section view taken along line 6-6 of the FIG. 5.
Figure 7:
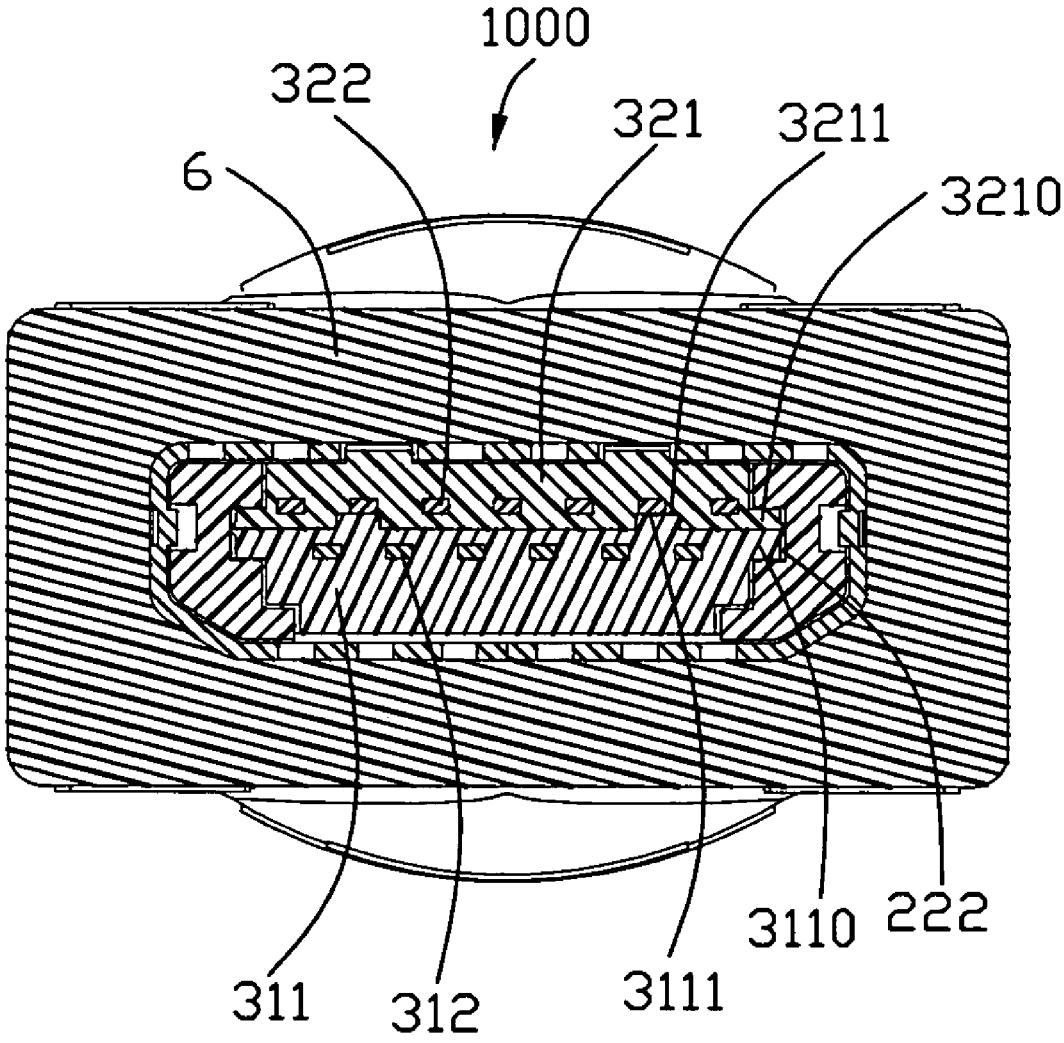
FIG. 7 is a cross-section view taken along line 7-7 of the FIG. 5.

Referring to FIGS. 1-7, a cable assembly 1000 comprises a metallic shell 1, an insulated housing 2, a contact module 3, a printed circuit board (PCB) 4, a cable 5 and an insulated cover 6.

The metallic shell 1 includes a first shielding member 10 and a second shielding member 12. The first shielding member 10 has an inverted U-shaped first shielding portion 100 and a cable holder portion 102 coupled to a back edge of an upper side of the first shielding portion 10. The second shielding member 12 has a rectangular-shaped sleeve portion 120 and a U-shaped second shielding portion 122 extending rearward from back edge of a bottom side of the sleeve portion 120. A tab 124 is formed at rear edge of a bottom side of the second shielding portion 122. The first shielding member 10 latches with the second shielding member 12, with protrusions 126 formed on lateral sides of the second shielding portion 122 locked into corresponding holes 102 in lateral sides of the first shielding portion 100.

The insulated housing 2 includes a main portion 20 and two arms 22 extending rearward from lateral sides of a back face of the main portion 20. A sunken port 200 is recess upwardly from a bottom surface of a front segment of the main portion 20. The sunken portion 200 is of U-shaped viewed from a front side (see FIG. 2). A cavity portion 206 is recessed forwardly form the back face of the main portion 20 and in communication to the sunken portion or mating port 200. Each arm 22 has a positioning portion 220 formed at rear segment thereof, and the positioning portion 220 is arranged offsetting from an extension of the arm 22, such that a distance between the two positioning portion 220 is larger than a distance between opposite sides of other sections of the arms 22. A positioning groove 222 is defined in an inner side of each positioning portion 220.

The contact module 3 includes a first contact module 31 and a second contact module 32.

The first contact module 31 includes six first contacts 312 arranged in a row along a transversal direction and molded with a first insulator 311. Every two adjacent first contacts 312 has a certain distance therebetween. Each first contact 312 has a retention portion (not numbered) embedded in the first insulator 311, a mating portion 3121 extending forward from the retention portion and beyond a front surface of the first insulator 311, and a tail portion 3122 extending rearward from the retention portion and outward a back surface of the first insulator 311. Two first stub portions 3110 are formed at rear sections of lateral sides of the first insulator 311 and proximate to the top surface of the first insulator 311.

The second contact module 32 includes seven second contacts 322 arranged in a row along a transversal direction and molded with a second insulator 321. Every two adjacent second contacts 322 has a certain distance therebetween. Each second contact 322 has a retention portion (not numbered) embedded in the second insulator 321, a mating portion 3221 extending forward from the retention portion and beyond a front surface of the second insulator 321, and a tail portion 3222 extending rearward from the retention portion and outward a back surface of the second insulator 321. The mating portions 3221 of the second contacts 322 extend downward from retention portions and arranged lower than the bottom surface of the insulator 321. Two second stub portions 3210 are formed at rear sections of lateral sides of the second insulator 321 and proximate to the bottom surface of the second insulator 321. A pair of positioning posts 3111 of the first contact module are inserted into the pair of corresponding positioning apertures 3211 of the second contact module 32, which insure the first and second contact modules 31, 32 assembled together accurately. Furthermore, a pair of locking tabs 3212 is arranged on a top surface of the second insulator 321, and the locking tabs 3212 may lock into locking holes (not numbered) in a top side of sleeve portion 120.

The first contact module 31 is overlapped with the second contact module 32, with the mating portions 3121 of contacts 312 respectively disposed between the mating portions 3221 of the contacts 322, the tail portions 3122 of the contacts 312 and the tail portions 3222 of the contacts 322 arranged into distinct rows along a vertical direction and further offset one another along the transversal direction. Thus, the mating portions 3121, 3221 of the first and second contacts 312, 322 are merged into a row along a transversal direction, while the tail portions 3122, 3222 of the first and second contacts 312, 322 are spaced one another and arranged into two rows along the transversal direction. Such arrangement facilitates soldering process.

The PCB 4 includes a circuit substrate 40 with a relative narrow mounting segment in the front end thereof. Six first conductive pads 41 are formed on an upper surface of the circuit substrate 10, and rear portions of the first conductive pads 41 are fanned out, such that space therebetween is increased. Six relative longer second conductive pads 42 and a relative shorter second conductive pad 43 are formed on a lower surface of the circuit substrate 10, and rear portions of the relative longer second conductive pads 42 are also fanned out. A mounting portion or the front portion 401 of the circuit substrate 40 is narrower than other part thereof and facilitates in assembling process.

The cable 5 includes a number of differential wire pairs 51 for transmitting differential signals and a jacket 50 enclosing outside of the wire pairs 51. Each differential wire pairs 51 include two individual signal wires 52 insulated from one another and a grounding wire or draining wire 53 associating with the corresponding signal wires 52.

When assembly, the first contact module 31 and the second contact module 32 are assembled together and inserted into the cavity portion 206 of the insulated housing 2, with mating portions 3221, 3121 disposed in the sunken port 200 of the insulated housing 2, the first stub portions 3110 overlapping the second stub portion 3210 and sandwiched in the positioning grooves 222; then the PCB 4 is mounted to the insulated housing 1, with the front portion 401 thereof inserted into the positioning groove 222 and disposed rearward of the first and second stub portions 3110, and the tail portions 3122, 3222 of the first and second contacts 312, 322 disposed on the first and second and third conductive pads 41, 42, 43 and soldered thereto. The signal wires 52 and grounding wires 51 are soldered to corresponding first and second conductive pads 41, 42. The insulated housing 2 is inserted into the sleeve portion 120 of the second shielding member 12, and the PCB 4 together with positioning portions 220 of arms 22 are disposed in the second shielding portion 122, with the positioning portions 220 abutting against rear edge of lateral sides of the sleeve portion 120. The first shielding member 11 is assembled to the second shielding member 12. Finally, the insulated cover 6 encloses the first shielding portion 100 and the second shielding portion 122 and partial of the cable 5 adjacent to the PCB 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

an insulated housing defining a cavity portion along a longitudinal direction;

a first contact module including a first insulator combined with a plurality of first contacts, each of the first contacts having a mating portion extending beyond a front surface of the first insulator and a tail portion disposed outside a back surface of the first insulator;

a second contact module including a second insulator combined with a plurality of second contacts, each of the second contacts having a mating portion extending beyond a front surface of the second insulator and a tail portion disposed outside a back surface of the second insulator;

the first insulator overlapped with the second insulator, with each of the mating portions of the first contacts disposed into a corresponding gap between two adjacent mating portions of the second contacts, and the tail portions of the first contacts spaced apart from the tail portions of the second contacts; and the first and second contact modules inserted into the cavity portion of the insulated housing, with the mating portions of the first contacts and the second contacts extending into a mating port of the insulated housing, and the tail portions of the first and second contacts disposed outside of the cavity portion of the insulated housing and adapted for soldering to wires.

2. The cable assembly as recited in claim 1, wherein the mating portions of the second contacts are arranged lower than a bottom surface of the second insulator.

3. The cable assembly as recited in claim 1, wherein two positioning posts formed on a top side of the first insulator extend into corresponding positioning apertures defined in a bottom side of the second insulator.

4. The cable assembly as recited in claim 1, wherein the tail portions of the first contacts offset the tail portions of the second contacts along a vertical direction perpendicular to a transversal direction.

5. The cable assembly as recited in claim 1, wherein two arms extend rearward from lateral sides of the back face of the insulated housing and the tail portions of the first and second contacts are disposed between the two arms.

6. The cable assembly as recited in claim 5, wherein a positioning groove is defined in an inner side of each arm.

7. The cable assembly as recited in claim 6, wherein two first stub portions are formed at lateral sides of the first insulator and project into the positioning grooves, wherein two second stub portions are formed at lateral sides of the second insulator and project into the positioning grooves.

8. The cable assembly as recited in claim 7, wherein the first stub portions and the second stub portions are overlapped one another and sandwiched in the positioning grooves.

9. A cable assembly, comprising:

an insulated housing defining a cavity portion along a longitudinal direction;

a first contact module including a first insulator combined with a plurality of first contacts, each of the first contacts having a mating portion extending beyond a front surface of the first insulator and a tail portion disposed outside a back surface of the first insulator;

a second contact module including a second insulator combined with a plurality of second contacts, each of the second contacts having a mating portion extending beyond a front surface of the second insulator and a tail portion disposed outside a back surface of the second insulator;

the first insulator overlapped with the second insulator, with the mating portions of the first contacts and the second contacts merged into one row along a transversal direction perpendicular to the longitudinal direction, and the tail portions of the first contacts and the second contacts spaced apart from one another and arranged into two distinct rows both along the transversal direction;

the first and second contact module inserted into cavity portion of the insulated housing, with the mating portions of the first contacts and the second contacts extending into a mating port of the insulated housing, and the tail portions of the first and second contacts disposed outside of the cavity portion of the insulated housing;

a printed circuit board having a plurality of conductive pads formed on at least one of an upper and a lower surfaces thereof, said tail portions of the first and second contacts disposed on and soldered to front portions of the conductive pads; and at least a cable including a number of wires soldered to rear portions of the corresponding conductive pads.

10. The cable assembly as recited in claim 9, wherein two arms extend rearward from lateral sides of the insulated housing and each arm has a positioning portion formed at a rear portion thereof, wherein a positioning groove is defined in an inner side of the positioning portion to accommodate a lateral edge of a front portion of the printed circuit board.

11. The cable assembly as recited in claim 10, wherein the front portion is narrower than other segment of the printed circuit board.

12. The cable assembly as recited in claim 11, wherein two first and second stub portions are formed at rear sections of lateral sides of the first and second insulators, wherein the first and second stub portions are overlapped each other and securely retained in the positioning grooves.

13. The cable assembly as recited in claim 10, wherein the positioning portions laterally project outward.

14. The cable assembly as recited in claim 13, wherein a shielding member has a sleeve portion and a shielding portion extending rearward from a lower side of the sleeve portion, wherein the insulated housing is inserted into the sleeve portion and the positioning portions abut against back edges of lateral sides of the sleeve portion.

15. The cable assembly as recited in claim 9, wherein the pads are formed on both said upper and lower surfaces, and the tail portions of the first and second contacts are respectively disposed on said upper and lower surfaces, respectively.

16. The cable assembly as recited in claim 9, wherein one of the conductive pad is arranged aside the front portions of the other conductive pads and shorter than the other conductive pads, and the one conductive pad is soldered to the corresponding tail portion of the contact.

17. A cable connector assembly comprising:

an insulative housing sub-assembly having a plurality of contacts therein and defining a mating port, a printed circuit board located behind the housing sub-assembly and defining opposite front and rear edge portions, a plurality of conductive pads formed on two opposite faces around the rear edge portions;

each of said contacts defining a mating portion exposed into the mating port, and a mounting portion attached to said front edge region;

a plurality of differential pair cables located behind the printed circuit board, each of said differential pair cables including two individual signal wires and a grounding wire under a condition that the two individual signal wires of each of differential pair cables are respectively located on the corresponding pads on said two opposite faces, and the grounding wires of said differential pair cables are alternately located upon the corresponding pads on said two opposite faces, respectively.

18. The cable connector assembly as claimed in claim 17, wherein said pads on each of said two opposite faces are lined with one another in a transverse direction.

19. The cable connector assembly as claimed in claim 18, wherein each of said differential pair cables defines a capsule like contour, and said differential pair cables form a zigzag cross-sectional configuration along said transverse direction so as to allow serial notches therealong to receive the corresponding grounding wires, respectively.

20. The cable connector assembly as claimed in claim 17, wherein the two neighboring grounding wires on the same one of said two opposite faces are separated from each other with two said signal wires of two said differential pair cables.

* * * * *